United States Patent [19]

Allgaier et al.

[11] Patent Number: 4,645,357

[45] Date of Patent: Feb. 24, 1987

[54] ELECTROPTICAL DETECTOR FOR DETERMINING THE POSITION OF THE TIME DISPLAY MECHANISM OF A TIMEPIECE

[75] Inventors: Jürgen Allgaier, Lauterbach; Wolfgang Ganter; Hans Flaig, both of Schramberg, all of Fed. Rep. of Germany

[73] Assignee: Junghans Uhren GmbH, Schramberg, Fed. Rep. of Germany

[21] Appl. No.: 789,157

[22] Filed: Oct. 18, 1985

[30] Foreign Application Priority Data

Nov. 9, 1984 [DE] Fed. Rep. of Germany ... 8432847[U]
Mar. 26, 1985 [DE] Fed. Rep. of Germany ..... 3510861

[51] Int. Cl.[4] ..... G04C 9/00

[52] U.S. Cl. ..... 368/187; 368/184; 368/46; 368/327; 368/80

[58] Field of Search ..... 368/157, 160, 46, 187, 368/76, 80

[56] References Cited

U.S. PATENT DOCUMENTS 4,420,263 12/1983 Besson et al. ..... 368/157

OTHER PUBLICATIONS

"Funkuhren (Radio Signal Timepieces)" edited by W. Hilberg (pp. 105–107).

*Primary Examiner*—Bernard Roskoski
*Attorney, Agent, or Firm*—Burns, Doane, Swecker & Mathis

[57] ABSTRACT

A timepiece receives an externally transmitted radio signal corresponding to an accurate time of day. Disposed within the timepiece is a detecting mechanism for detecting the time of day being displayed by the timepiece. The signals are compared to determine the accuracy of the timepiece. The detection mechanism comprises an optoelectrical system which includes an emitter for directing a beam of radiation toward the sensor. The wheels of the gearworks intersect the beam ahead of the sensor to normally block the beam from the sensor. The wheels include orifices which, when aligned with the beam, permit the beam to reach the sensor, thereby providing an indication of the position of the wheels, and thus of the time being displayed.

13 Claims, 5 Drawing Figures

28
27
29
30
II
II
37
1
2
3
4
5
6
7
8
9
10
11
12
13
14
15
16
17
18
19
20
21
22
23
24
25
26
31
32
33
34
35

ELECTROPTICAL DETECTOR FOR DETERMINING THE POSITION OF THE TIME DISPLAY MECHANISM OF A TIMEPIECE

RELATED INVENTION

This invention is related to that described in copending U.S. application Ser. No. 06/791,555, filed Oct. 25, 1985 by Jurgen Allgaier and Wolfgang Ganter (corresponding to German Application Ser. No. P 34 39 638.1-31 filed Oct. 30, 1984). The subject matter of that application is hereby incorporated by reference herein.

BACKGROUND AND OBJECTS OF THE INVENTION

The present invention relates to a mechanism for determining the accuracy of a timepiece such as a watch. Such a mechanism has particular utility in the case of timepieces which include a receiver for receiving radio signals from an external source corresponding to the accurate time of day, which signals are compared with internal signals generated within the timepiece indicative of the time of day displayed by the timepiece.

A detection device of this type is known from the article by H. Effenberger, "Radio-Signal Timepiece Controlled by Microprocessors With Analog Display" in a book entitled *Radio Signal Timepieces,* edited by W. Hilberg (pp. 105–107). It is disclosed therein that a reflectable light beam be established in the face of the timepiece in such manner that when the hour and minute hands are oriented to shade an optoelectronic receiver system, a signal is generated whereby the fact that one of these hands has been rotated at this instant into a predetermined angular position is detected. A disadvantage of a detection device of this type is that both the hour and minute hand must be capable of being rotated independently of each other, i.e., they must be driven by separate stepping motors or by means of change gears. This raises the cost of the manufacture and operation of a timpiece of this type and in particular, in case of change gears, also the vulnerability of the clock mechanism. A further disadvantage of the known detection device is that, as the result of scattered light influences, it is difficult to identify the exact light-blocking position of the hands. Also, hands of different widths may lead to different signal actuation times. Open-work perforated hands, such as those found in fashion watches, may even produce multiple signals and thus erroneous evaluations, which may be compensated for only by means of particularly expensive electronic correction devices in order to insure the high display accuracy expected by consumers from a radio signal timepiece. The design of the face of a radio signal timepiece may be complicated by the need for arranging the optical sensor into the minute works in a highly visible manner, so that hands of different lengths are able to pass over it.

In view of these facts, it is an object of the invention to provide a detection device of the abovementioned type, wherein it is unnecessary to position sensors in visually disadvantageous locations, and wherein no restrictions are placed on the design of the hands.

Another object is to improve the operational safety of such a device.

SUMMARY OF THE INVENTION

These objects are achieved by the present invention which relates to a drive mechanism for use in a timepiece of the type comprising a time display mechanism. The drive mechanism comprises a gear works including a rotary wheel arrangement for driving the display mechanism. A drive motor actuates the gear works. An optoelectrical detection mechanism is provided for detecting the time of day being displayed. The optoelectrical detection mechanism comprises a device for directing at least one beam of radiation toward the wheel mechanism and a sensor positioned for receiving the beam. The wheel mechanism intersects the beam ahead of the sensor to normally block the beam from the sensor. The wheels include orifices arranged to be periodically aligned with the beam to permit the beam to be received by the sensor at a predetermined rotational position of the wheel to provide an indication of the time being displayed.

Such a mechanism is particularly useful in a timepiece whose accuracy is controlled by an externally emitted radio signal which corresponds to an accurate time of day. The external signal is compared to a signal received from the sensor within the timepiece to generate an output signal for adjusting the gear works if inaccuracies are detected.

By providing an arrangement wherein the sensing of the position of hands occurs inside the mechanism, no restrictions are placed on the design of the face and hands of a timepiece. The mechanism is possessed of a configuration, including the hand position detection device, that is, overall, compact and entirely capable of independent operation for testing before installation in a timepiece housing.

In the case of arrangement wherein a stepping motor drives a minute wheel and an intermediate wheel, information concerning the position of the hands can be obtained every twelve hours (accurately to the minute) by a sensing of the minute wheel. This occurs independently of the size and shape of the hands. In addition, a sensing of a fourth wheel, including its intermediate wheel, produces hand position information every minute, accurate to the second. The coupling of this information by means of an electric circuit (or a common light beam) results in the actuation of a hand-position detection signal accurate to the second, not only of the second hand, but also the minute and hour hands driven by the minute hand.

Following the assurance of a defined hands position in the course of a revolution of the hour hand, the subsequent movement of the hands may be determined merely by counting the stepping pulses onward from this detection position.

Further embodiments, together with further characteristics and advantages of the invention are described hereinafter.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
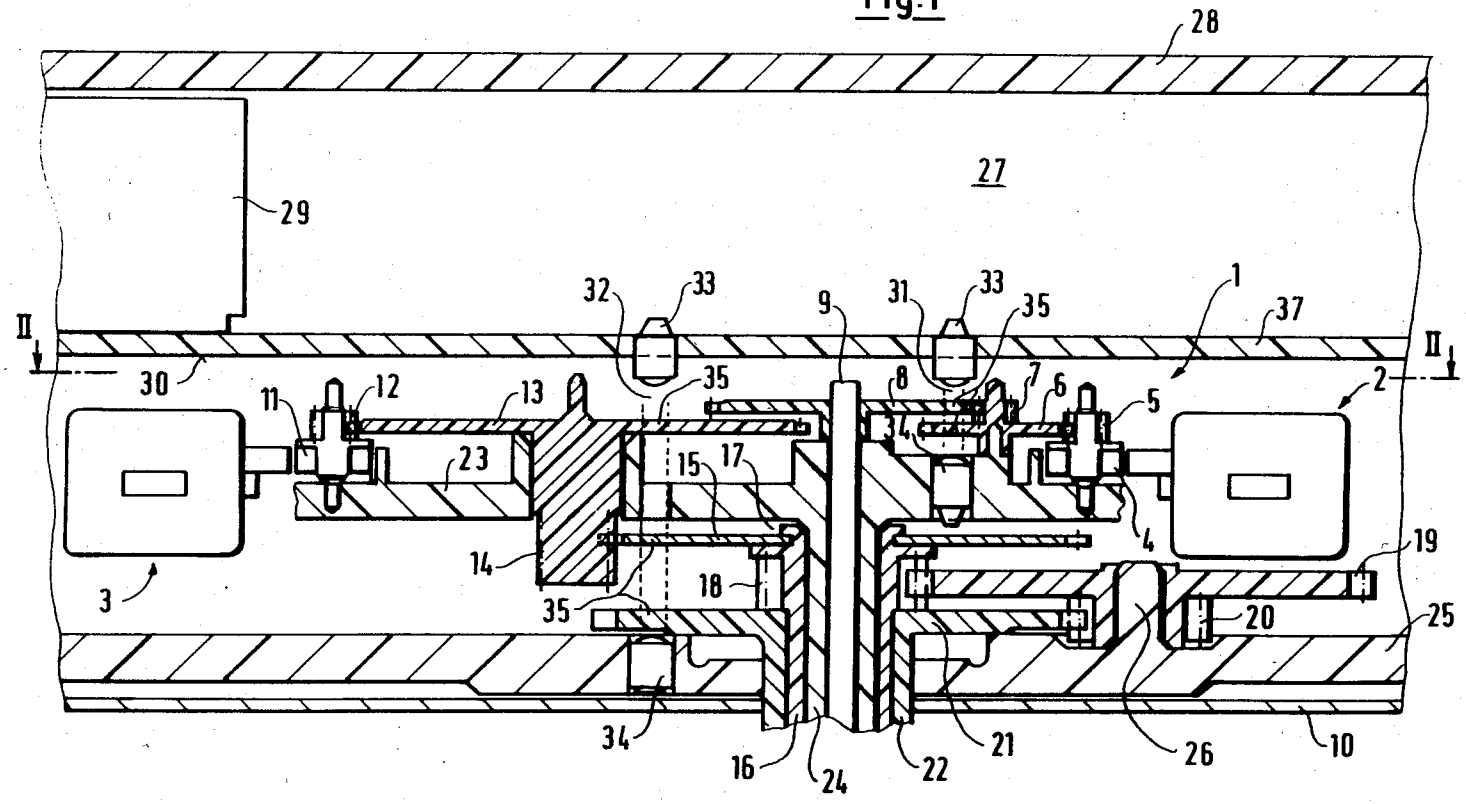
FIG. 1 depicts, in a longitudinal sectional view, a clock mechanism with two separate stepping motors, one to drive the seconds hand and the other to drive the minute and hour hands, as well as two light beams.
Figure 2:
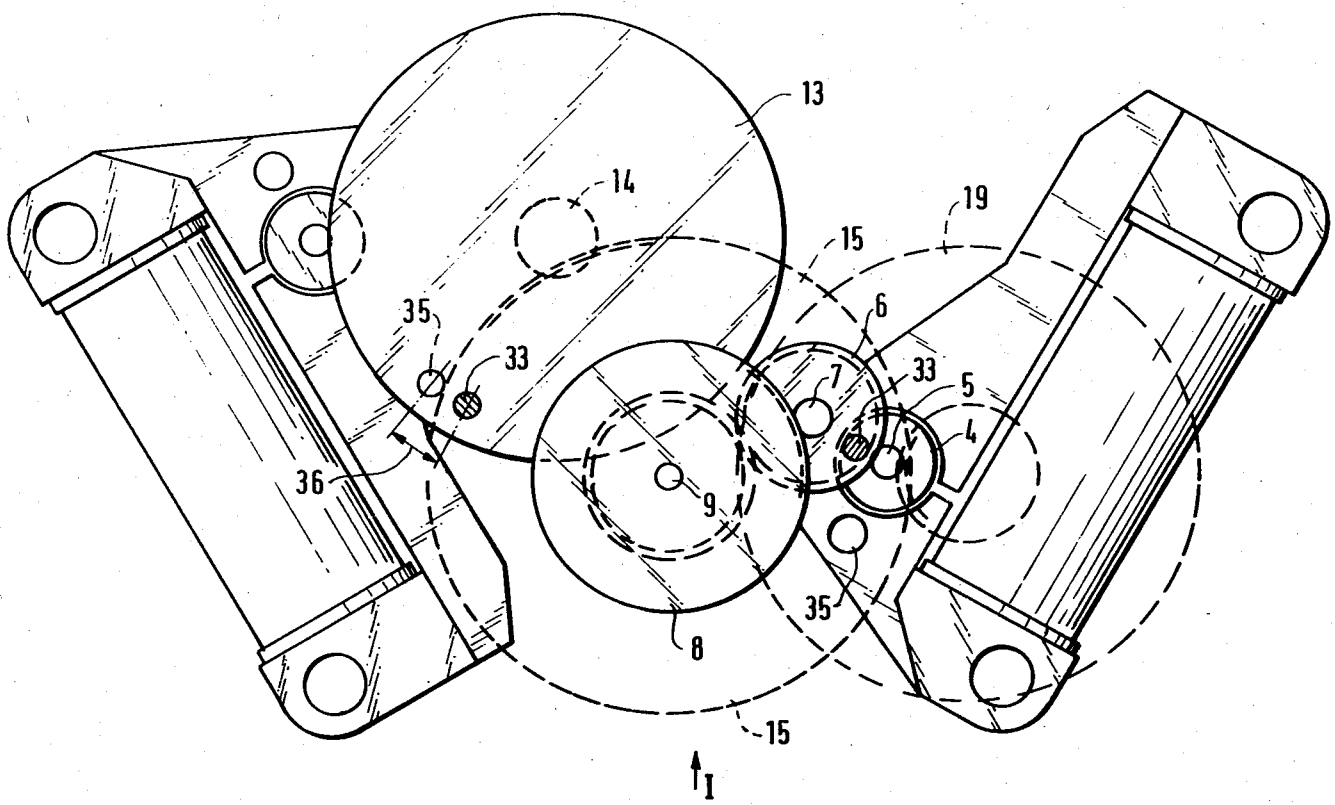
FIG. 2 is a plan view of the mechanism according to FIG. 1.

A clock mechanism is depicted in FIGS. 1 and 2, in which two independently actuated stepping motors 2, 3 are provided. The clock can be for a wristwatch, for example. The rotor 4 of the seconds hand stepping motor 2 is connected to a pinion gear 5 which drives an intermediate wheel 6 and its pinion 7. The pinion 7 drives a fourth wheel 8 and the seconds-hand shaft 9 joined fixedly in rotation with the fourth wheel 8. Rotation of the shaft 9 produces rotation of the seconds hand (not shown) arranged on a face of the watch.

The rotor 11 of the second motor 3 drives a pinion 12 and the latter drives an intermediate wheel 13. A pinion 14 of the wheel 13 drives a minute wheel 15, the latter being connected to a hollow minute hand shaft 16. The shaft 16 is connected frictionally at 17 with the wheel 15. Rotation of the hollow shaft 16 produces rotation of a pinion 18 which drives a changing wheel 19. The wheel 19 drives a pinion 20 which, in turn, rotates an hour wheel 21. The hour wheel 21 is rigidly connected with a hollow shaft 22 which carries an hour hand (not shown).

The rotors 4, 11 and the intermediate wheels 6, 13 are carried by a carrier plate 23, the latter forming a central socket bearing 24 for the second-hand shaft 9. The bearing 24 extends through the hollow shafts 16, 22.

In front of a side 25 of the housing the watch face 10 is situated. Formed integrally on an inner surface of the side 25 is a bearing 26 upon which is mounted the intermediate wheel 19. The mounting of the carrier plate 23 and its step motors 2, 3 on the housing side 25 is not shown in the drawing. Behind the mechanism 1 a conductor plate 37 is arranged to contain the mechanism 1.

A recess 27 is formed between the conductor plate 37 and a back side 28 of the housing. Disposed in the recess 27 are electrical elements 29 for a radio receiver and for the time-keeping watch circuit (only indicated symbolically in the drawing). These construction elements 29 are connected electrically with printed circuit paths 30 on the conductor plate 37.

A certain angle position of the clock hands corresponds to a certain turning position of the wheels 8, 13, 15 of the mechanism 1. For the detection of the entry of the rotation angle into this position at least one, but preferably two energy beams 31, 32 are provided, such as visible light or infrared light for example. For reasons of operational safety, preferably no reflectable beams are employed. Rather, a conventional optical radiation emitter 33 is aligned with a cooperating radiation receiver 34. The beams 31, 32 are interrupted by the wheels 6, 8 and 13, 15, 21, respectively, unless apertures 35 in those wheels are aligned with each other and with the beams 31, 32.

The diameters of the orifices 35 in the most rapidly running wheels of the mechanism 1 entering the beams 31, 32 (i.e., the intermediate wheels 6 and 13), are made shorter than the arc segment 36 traveled by those wheels during each incremental movement produced by the stepping motor 4 or 11.

The intermediate wheel 13, the minute wheel 15 and the hour wheel 21 are interconnected such that their orifices 35 become aligned with one another once every twelve hours. Consequently, once every twelve hours the beam 32 optically actuates the receiver 34 to emit an electrical signal that is accurate to the minute. In contrast, the orifices of the fourth wheel 8 and the intermediate wheel 6 become aligned with one another once every minute. The receiver 34 therefore emits a pulse once every minute, accurately to the second. For this reason, the electrical combination of the output signals of the receivers 34 (for example, by a coupling of their signals in a conventional AND combinatorial circuit, not shown herein) produces a signal accurate to the second, every twelve hours as an electrical information, indicating that the minute hand (also the hour hand due to the driving connection in the mechanism 1) occupies instantaneously one and only one definite (reference or detection) angular position, predetermined by the design layout of the orifices 35.

Figure 3:
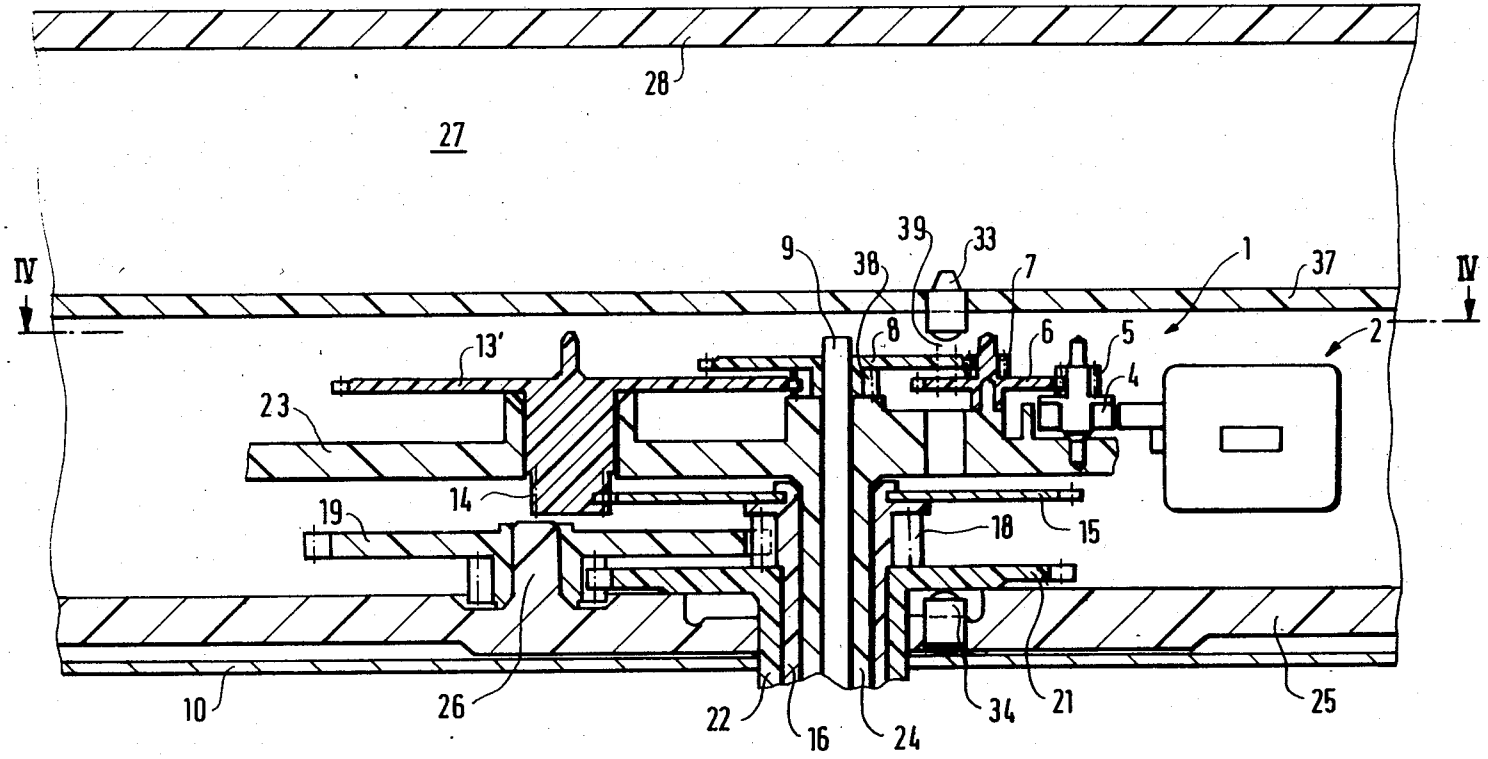
FIG. 3 is a view similar to FIG. 1, depicting a modification in which one stepping motor and one light beam are employed.
Figure 4:
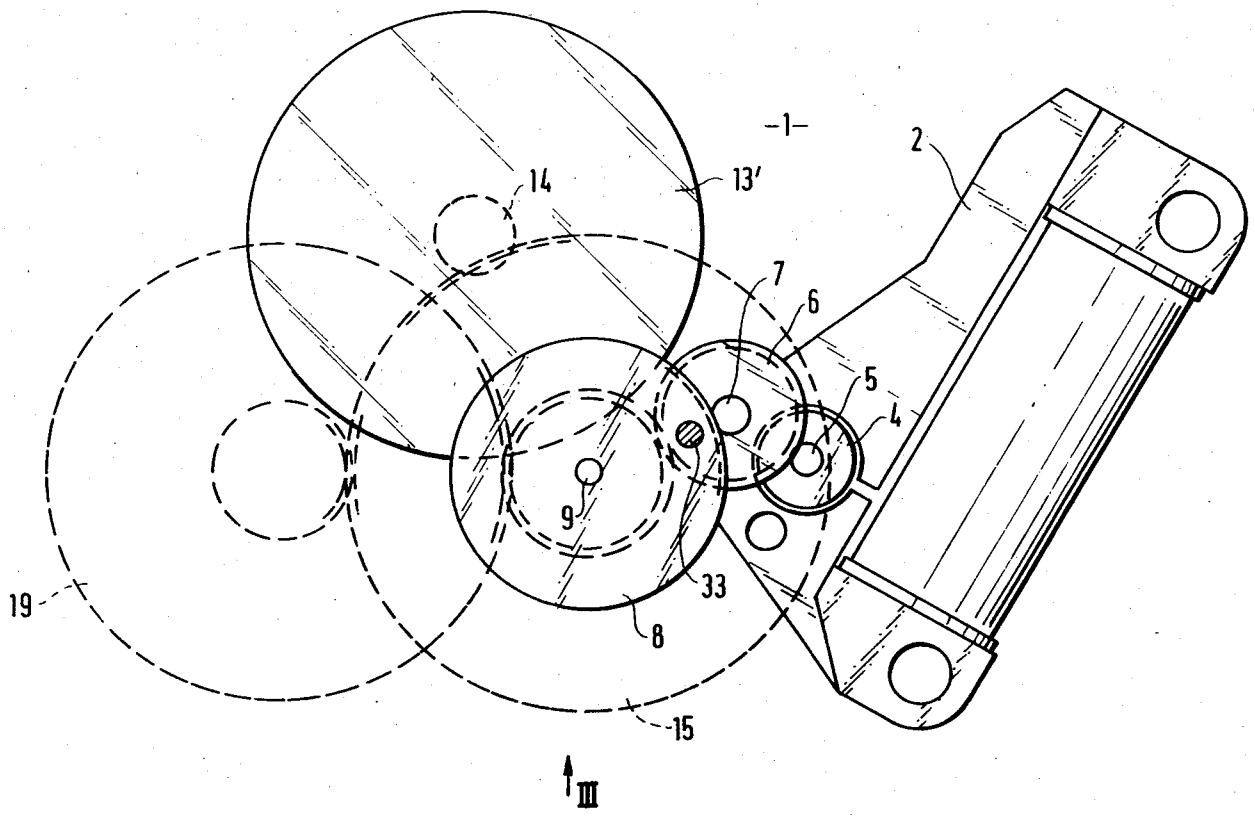
FIG. 4 is a plan view of the mechanism according to FIG. 3.

In another embodiment of the invention according to FIGS. 3, and 4, only one stepping motor 2 is provided, which drives the fourth wheel 8 by means of the intermediate wheel 6. The minute wheel 15 is driven by means of a fourth wheel pinion 38 through the third or intermediate wheel 13'. Only one beam 39 is provided and it extends between a radiation emitter 33 (disposed in the circuit board 37), and a radiation receiver 34 (disposed in the front wall 25 of the case). That beam 39 intersects not only the fourth wheel 8 and its intermediate wheel 6, but now also the hour wheel 21 and the minute wheel 15, each equipped with an orifice. This results every twelve hours in the mutual alignment of the orifices 35 whereby the receiver 34 emits a signal accurate to the second since the intermediate seconds wheel 6 is the carrier of the most rapidly moving orifice 35. This signal is generated without the need for the electrical combination of the output signals of two receivers 34, as in the embodiment accoding to FIGS. 1 and 2.

Figure 5:
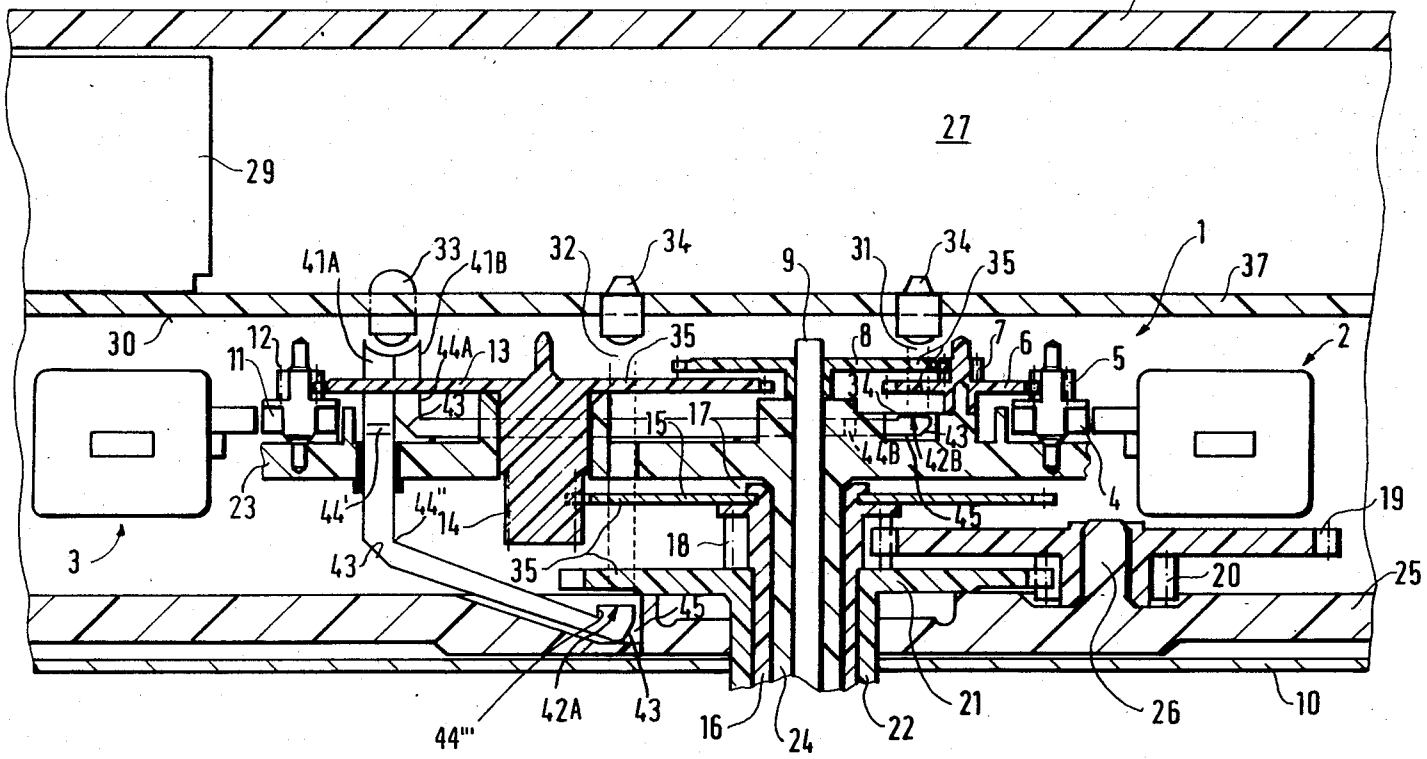
FIG. 5 is a view similar to FIG. 1 of another modification.

A further embodiment of the invention according to FIG. 5 represents a design simplification with respect to the embodiment according to FIG. 1. In the embodiment according to FIG. 5, a single radiation emitter 33 is provided, which emitter is common to the plurality of beams 31, 32. That emitter 33, plus a plurality of radiation receivers 34, are positioned in the circuit board 37 and connected mechanically and electrically therewith. The optical radiation energy is conducted by radiation conductors 41A, which are adapted to the particular range in the spectrum of the beams being sent (e.g., acrylic glass for radiation in the range of visible light or gerandium for radiation in the farther infrared range). The conductors 41A,B conduct the radiation from the common sender 33 to the respective irradiation positions 42A, 42B of the light barriers 31, 32. Thus, there is no need for an emitter/receiver pair per each stepping motor, or for an emitter per each stepping motor.

It is more preferable to form the geometrical configuration of the conductors 41A,B of rigid material by machining or chipless methods rather than the use of flexible optical fibers, as the desired shapes may be dimensioned in keeping with the spatial conditions in the clock mechanism 1 and thus are ready to be mounted in the clock mechanism 1 with the correct dimensions. That is, smaller radii can be realized from rigid bodies 41 having titled mirrors 43 than from bent optical fibers, as is known for example from floodlight reflection technology. Also, a rigid conductor can be mechanically fastened at virtually any point along its length, whereas a flexible optical fiber must normally be fastened at its outlet end. In the example of embodiment shown in FIG. 5, two conductors 41 have inlets in front of the sender 33 and then branch out in keeping with space conditions. The two rigid conductors 41A,B are mounted on the support plate 23, which determines the positioning of the gear mechanism and thus the location of the orifices 35. One conductor 41A extends from a plane located behind the plane of the drawing and through an angle 44' into the plane of the drawing and through a further angle 44'' into a recess 45 on the inside of the front wall 25 of the case, wherein it terminates, after traversing a last angle 44''', with a radiation outlet surface in the irradiation position 42A. The other conductor 41B is angled at 44A and extends parallel to the support plate 23 behind the plane of the drawing in order to enter the plane of the drawing, through a recess 44B in the support plate 23. The conduit 42B terminates with a radiation outlet surface in the irradiation position 42B.

In accordance with the present invention according to FIG. 5, simplified manufacturing and installation conditions, particularly in view of the location of the electrical structural elements exclusively in the circuit board 37. This also results in increased operating safety, which is further enhanced by the improved shielding against foreign radiation. Furthermore, a reduction in the axial structural height occurs as compared, for example, to the embodiment according to FIG. 1, as the axial heights of the sender 33 and the receiver 34 are not coaxial. Also, the outlets of the conduits 41A, 41B can be arranged in compact and less accessible positions.

The light barriers 31, 32 39 operate preferably in the infrared spectrum, as the emitters or senders 33, in the form of radiation emitting diodes, can have very small dimensions and may be operated at a voltage of less than 1.5 Volt, i.e., in the manner of a battery-operated clock mechanism by a single cell. In addition, receivers 34 tuned to an infrared radiation spectrum eliminate the need for optical shielding against foreign light effects from the environment of the mechanism 1. The arrangement of the light barriers 31, 32 and 39, respectively, within the practically closed case of the mechanism 1 provides, in and of itself, a degree of shielding that is usually sufficient for practical needs.

If passage of one of the light barriers 31, 32, 39 is permitted through axially aligned orifices, the hands moved by the associated stepping motor 2 or 3 are in a defined reference position. By electrically coupling the structural elements 29 so as to count the subsequent stepping motor pulses, electric information concerning the instantaneous position angular position of the hand with respect to the reference position is continuously available.

If, however, an electrical or mechanical failure should cause an error, it will be necessarily corrected when the reference position is next attained.

It will be appreciated that the signals generated by the receivers 34 in the afore-described embodiments are combined and fed to the circuitry 29 for comparison with an external radio signal received by the timepiece. That circuitry 29 is described in detail in the earlier referenced copending application. As a result of such comparison, it can be determined whether the time of day display is accurate; if not, then correction can be made.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. In a timepiece of the type comprising time display means, a gearworks including rotary wheel means for driving said display means, drive means for actuating said gearworks, and an optoelectrical detection means for detecting the time of day being displayed, the improvement wherein said optoelectrical detection means comprises beam directing means for directing at least one beam of radiation toward said wheel means, and sensor means positioned for receiving said at least one beam, said wheel means comprising a plurality of wheels disposed inbetween said beam directing means and said sensor means for intersecting said at least one beam ahead of said sensor means in order to normally block said at least one beam from said sensor means, said plurality of wheel each including an orifice arranged to be periodically aligned with said at least one beam to permit the latter to be received by said sensor means at a predetermined rotational position of said plurality of wheels to provide an indication of the time being displayed, said plurality of wheels being driven incrementally, the diameter of the orifice in the most rapidly rotating one of such plurality of wheels being no larger than the distance which such orifice is rotated during each rotational increment, said plurality of wheels intersecting said beam such that said orifices in said plurality of wheels must be aligned simultaneously with such beam to actuate said sensor means.

2. Apparatus according to claim 1, wherein said at least two wheels comprise a portion of said gearworks which drives a seconds indicator of said display means.

3. Apparatus according to claim 1, wherein said at least two wheels comprise a portion of said gearworks which drives a minutes indicator of said display means.

4. Apparatus according to claim 3, wherein a third wheel intersects said radiation beam intersected by said two wheels, said third wheel comprising a portion of said gearworks which drives an hour indicator of said display means.

5. Apparatus according to claim 1, wherein said drive means comprises a plurality of stepping motors, each stepping motor actuating a set of said wheels, said optoelectrical detecting means forming a separate radiation beam for each said set of wheels.

6. Apparatus according to claim 5, wherein said directing means comprises an emitter for emitting a beam of radiation and a plurality of optical conductors aligned with such beam for creating a corresponding plurality of separate beams, said sensing means comprising a sensor for each of said separate beams.

7. Apparatus according to claim 6 including a support plate on which at least some of said wheels are rotatably mounted, said optical conductors being mounted on said support plate.

8. Apparatus according to claim 1, wherein said drive means comprises a single stepping motor driving all of said wheels, there being a single radiation beam for all of said wheels.

9. Apparatus according to claim 8, wherein there are four said wheels intersecting said single radiation beam.

10. Apparatus according to claim 1, wherein said optoelectrical detecting means generates a radiation beam in the infrared spectrum.

11. Apparatus according to claim 1, wherein said directing means comprises at least one beam emitter, said at least one beam emitter and said sensing means being mounted on a common circuit board.

12. Apparatus according to claim 1, wherein said directing means comprises at least one beam emitter, said at least one beam emitter and said sensing means being mounted in opposing walls of said timepiece, said gearworks disposed between said walls.

13. Apparatus according to claim 1, wherein said timepiece includes means for receiving an external radio signal and for comparing said signal with signals received from said sensor means for determining the accuracy of said gearworks.

* * * * *